US005148571A

United States Patent [19]

Brazis et al.

[11] Patent Number: 5,148,571

[45] Date of Patent: Sep. 22, 1992

[54] LINT BRUSH ASSEMBLY

[75] Inventors: William E. Brazis, Medina; Rex R. Mast, Orrville, both of Ohio

[73] Assignee: Rubbermaid Incorporated, Wooster, Ohio

[21] Appl. No.: 819,056

[22] Filed: Jan. 10, 1992

[51] Int. Cl.[5] ..... A47L 25/08

[52] U.S. Cl. ..... 15/104.2; 15/106; 15/118; 15/231; A47L/25/08

[58] Field of Search ..... 15/104 A, 114, 118, 15/184, 258, 231, 106

[56] References Cited

U.S. PATENT DOCUMENTS

| | | | |
|---|---|---|---|
| 3,800,353 | 4/1974 | Roth | 15/184 |
| 4,642,835 | 2/1987 | Schmitz | 15/104 A |
| 4,850,073 | 7/1989 | Preuss | 15/159 |

OTHER PUBLICATIONS

Price List, Brushes, Helmac Products Corporation, P.O. Box 73, Flint, Mich., 48501-0073, Publication date Jan., 1990.

P. 23, Brushes, Empire Brush, Inc., U.S. Highway 13 North, P.O. Box 1606, Greenville, N.C. 27835. Publication date 1986.

Label and Photograph, Brush, Empire Brush, Inc., U.S. Highway 13 North, P.O. Box 1606, Greenville, N.C. 27835. Publication date 1987.

Label, Brush, Roth (Plastics) Corporation, P.O. Box 434, Lewiston, N.Y. 14092. Publication date 1978.

Catalog Page, Brush, Dupol-Rubbermaid GmbH, Fabrik fur Gummiund Kunststsfferzeugnisse, 60 72 Dreieichenhain bei Ffm., West Germany. Publication date 1970.

Catalog Page, Brush, Dupol-Rubbermaid GmbH, Fabrik fur Gummiund Kunststsfferzeugnisse, 60 72 Dreieichenhain bei Ffm., West Germany. Publication Date 1971.

Catalog Page, Brush, Dupol-Rubbermaid Gmbh, Fabrik fur Gummiund Kunststsfferzeugnisse, 60 72 Dreieichenhain bei Ffm., West Germany. Publication data 1972.

*Primary Examiner*—Philip R. Coe
*Assistant Examiner*—Randall E. Chin
*Attorney, Agent, or Firm*—Richard B. O'Planick

[57] ABSTRACT

A lint brush is disclosed comprising a unitarily formed, one-piece brush body (4) having a handle portion (16) at one end and a brush block portion (14) at an opposite end, the block portion having top and bottom recesses (20) and at least two transverse through bores (26) extending therethrough, whereby one recess communication with the other. A pair of identical insert members (6,8) are inserted into the recesses, and provide stakes (42) which project through the block portion through bores and into appropriately located apertures (41) of the opposite insert plate, whereby securing the assembly together. A lint attracting pad (12) is provided for each insert plate, and overlaps outwardly directed insert plate teeth (36), which, upon insertion of the insert plate into a block portion recess, trap lower edges of the lint pad against sidewalls (22) defining the recess. The pad is securely held for reciprocal movement across a garment.

7 Claims, 3 Drawing Sheets

FIG. 1
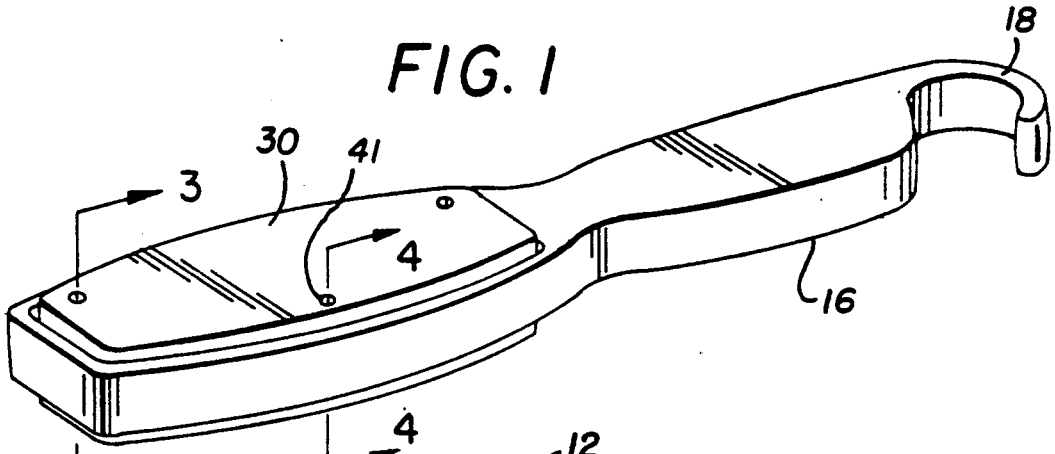
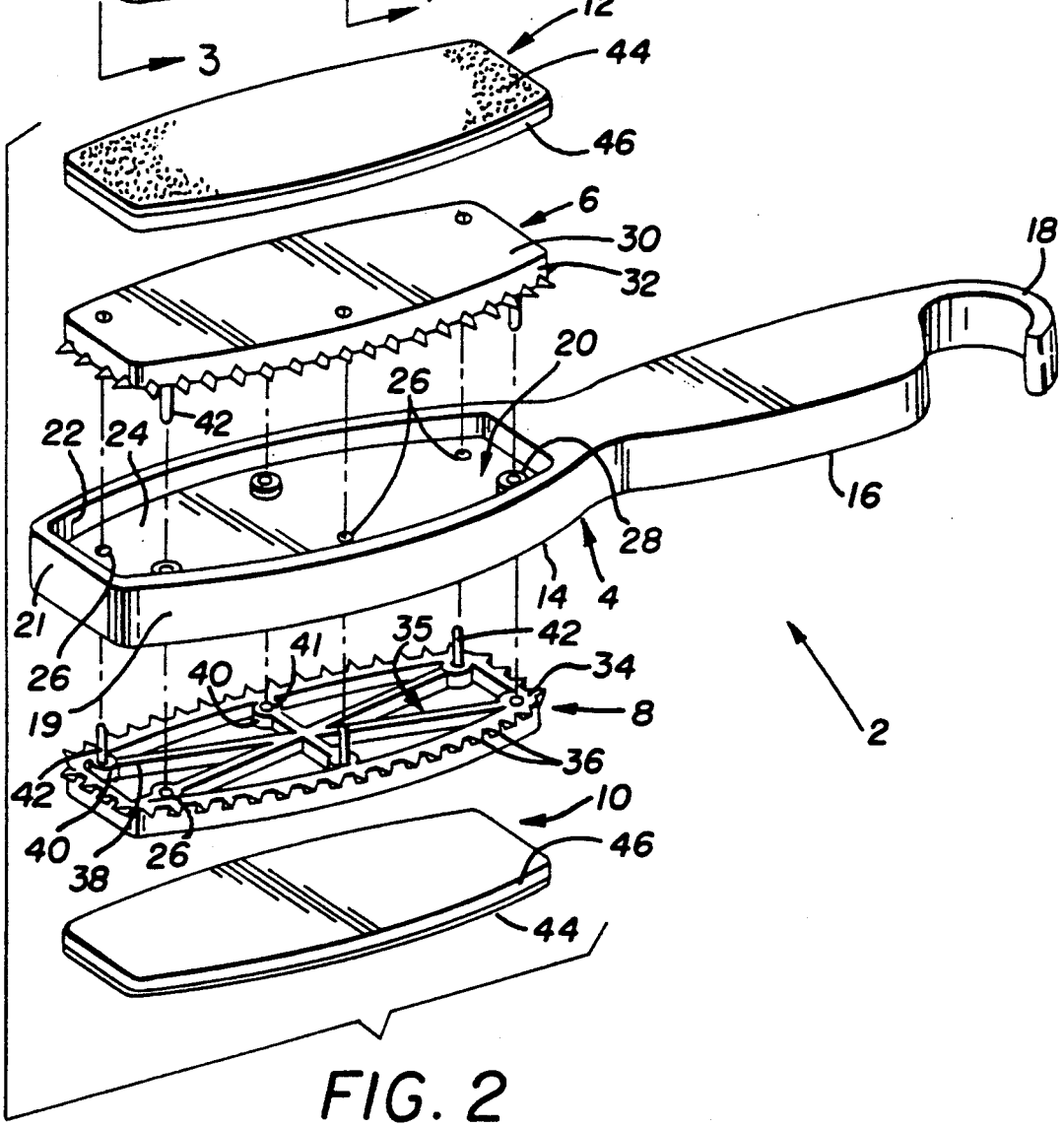
FIG. 2

LINT BRUSH ASSEMBLY

BACKGROUND OF THE INVENTION

1. Field of the Invention

This invention relates generally to lint brushes, and more specifically to two-sided lint brushes formed by assembling a lint-attracting pad to retaining components.

2. The Prior Art

Lint brushes are in common use. Typically, a brush will have lint attracting fabric on both sides of one end of brush, and a handle at the other end. The brush body is formed of two pieces, separated along a longitudinal axis of the brush. A lint pad is inserted over a retainer insert, which is then inserted into a recess in one of the brush body halves. Thereafter, the two halves of the brush are assembled together to create the final brush.

While the above, state of the art brush, works well, certain shortcomings in the brush prevent it from representing an ideal solution to the consumer's needs. First, assembly of the lint pad to the brush halves and then the brush halves together is labor intensive, adding significantly to the cost of the brush.

Secondly, each half of the brush body must be relatively thick in the lint pad holding block portion, to support the insertion of the lint pad therein. Adding the two, relatively thick, halves together creates an overall thickness in the pad area which is greater than optimal. A thicker brush is harder to use and control, particularly for women.

Finally, creating the brush from two halves mandates that the handle be hollow, and that the brush body have a longitudinal seam the length thereof. The handle, because of its hollow nature, feels insubstantial and weak, and does not have a good "feel". Moreover, the seam along the length of the brush is unsightly, and can become loose therealong if the attachment between the brush halves weakens.

SUMMARY OF THE INVENTION

The present invention overcomes the deficiencies attendant conventional lint brushes by providing an integral, unitarily molded brush body having a handle at one end and a brush block portion at the opposite end. The brush block has recesses formed in oppositely facing surfaces, each adapted to receive one insert member therein. The insert member has a top surface over which a lint pad is placed, and outwardly directed teeth along sidewalls, adapted to engage lower edge portions of the lint pad and thereby secure the pad to the insert member. The brush block body has spaced through-bores and reinforcement bosses therearound, and each insert member is provided with spaced apertures and outwardly directed stakes, which align and extend through the brush block through-bores and into appropriate aperture of the opposite insert member, whereby attaching in press fit manner the two insert members to opposite sides of the brush block portion.

The insert members are identically configured and reversible, such that an insert member may be used on either side of the brush block. In addition, the handle of the brush body is solid and of unitary construction, creating a better "feel". Lastly, because of the reversibility of the insert member and the unitary configuration of the brush body, a complete two-sided brush is assembled from just five components. at substantial cost saving.

Accordingly, it is an objective to provide a lint brush assembly having a brush body formed unitarily of plastic material, by conventional manufacturing processes.

It is a further objective to provide a lint bush assembly having a relatively few number of component parts.

Still a further objective is to provide a lint brush assembly having a two sided brush block portion, of relatively few component parts.

Yet a further objective is to provide a lint brush assembly which has a solid handle, and low profile brush block portion.

Another objective is to provide a lint brush assembly which has reversible lint pad insert members, attachable to either side of the brush block.

A further objective is to provide a lint brush assembly having positive means for attaching lint pads to a unitary brush block portion.

Still a further objective is to provide a lint brush assembly which is economically and readily manufactured and assembled.

These, and other objectives, which will be apparent to one skilled in the art, are achieved by a preferred embodiment which is described in detail below, and which is illustrated by the accompanying drawings.

BRIEF DESCRIPTION OF ACCOMPANYING DRAWINGS

FIG. 1 is a partial assembled perspective view of the subject invention, showing the insert plate members assembled to the brush block portion.

FIG. 2 is an exploded perspective view of the subject assembly.

DESCRIPTION OF THE PREFERRED EMBODIMENT

Figure 3:
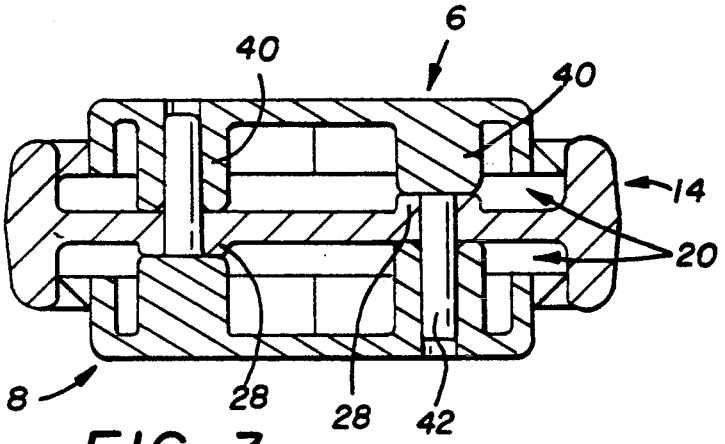
FIG. 3 is a sectional view through the partially assembled brush depicted in FIG. 1, taken along the line 3—3.

Referring first to FIG. 2, the brush assembly 2 is seen to comprise an elongate, integrally molded body 4, two insert plate members 6,8, and two lint pads 10,12. The body 4 and plate members 6,8 are conventionally molded of plastics material, preferably polypropylene.

Continuing, the body 4 has a forwardly disposed block portion 14 and a rearwardly disposed handle portion 16 which terminates at a hook 18. The block portion 14 is formed to have vertical sidewalls 19, and a recess 20 formed in opposite top and bottom surfaces, the top surface 21 being depicted in FIG. 2. The recess 20 in opposite sides of the block 4 is generally rectangular, having parallel ends and elliptical sidewalls 22 which terminate at an internal floor surface 24. The recesses 20 occupy substantially all of the upper and lower surfaces of the block portion 14.

As shown, six staggered throughbores 26 extend through the floor surface 24 of the block portion recesses 20, with alternate throughbores having a truncated cylindrical boss 28 therearound. The cylindrical bosses 28 extend upwardly from the floor surface 24 of each recess 20.

It will be appreciated that the insert plate members 6 and 8 are identical, being manufacturable from the same mold. The configuration of the plate member is such that it can, by reversal, be used on either side of the body block portion 14. Cost savings are achieved thereby.

Each insert plate is configured having an outward facing surface 30 and sidewalls 32, and an inward facing surface 34. A recess 35 is formed into the surface 34, and is crisscrossed by reinforcement ribs 38. A series of horizontal, outwardly directed teeth 36 are spaced along a lower edge of sidewalls 32, at surface 24. The teeth 36 extend about the lower periphery of the sidewalls 32.

The reinforcement ribs 38 extend in diagonal and transverse directions. At each end of the ribs 38 a cylindrical boss 40 is provided, marking the point where through bores 41 or outwardly directed stakes 42 are located. It will be appreciated that each rib 38 has a stake 42 at one end, and a through bore 41 at the other. Accordingly, the stakes 42 of plate 8, which is reversed from plate 6, will align with through bores 26 of the brush block 14 and corresponding apertures 41 of the plate 6, and vice versa. The through bores 26 are sized to admit a stake 42 therethrough, with clearance, while the size of apertures 41 is such to accommodate a press fit of stake 42 therein.

The complementary size and shape of the insert plates 6,8 and the block recess 20 will be readily noted from FIG. 2. The relative dimensions are such that the plate 6 is closely received within the recess 20, with the tips of teeth 36 in close proximity to the sidewalls 22.

The two lint pads are conventionally formed, comprising an outer layer of lint attracting material 44, and an underlying layer of foam material 46. Each pad 10,12 is identically formed and dimensioned for application to the outward surface 30 of the insert plate, and such that lower edge portions of the pad overlap the points of the teeth 36. Thereupon, the combined insert and pad is attached to the block 14, with stakes 42 extended through appropriate through bores 26. The close spacing between the points of the teeth 36 and sidewalls 22 of the recess entraps the lower edge portion of the pad 12, securely retaining the pad in position. The same assembly sequence occurs on the other side.

Figure 4:
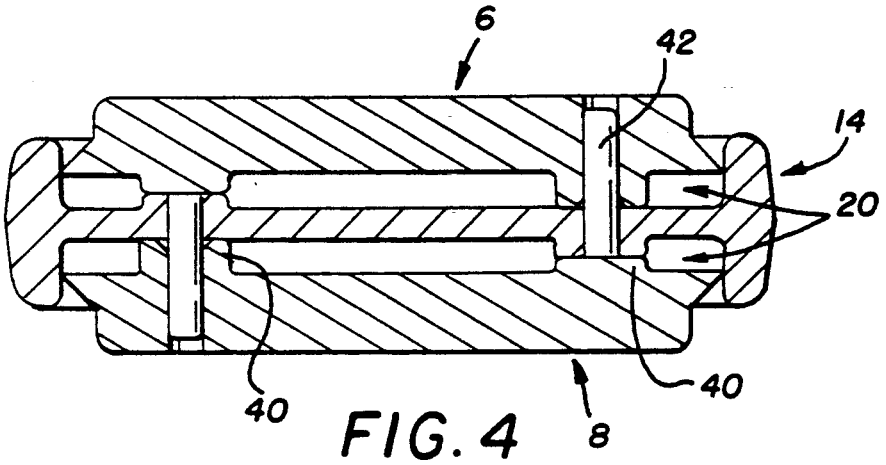
FIG. 4 is a sectional view through the partially assembled brush depicted in FIG. 1, taken along the line 4—4.
Figure 5:
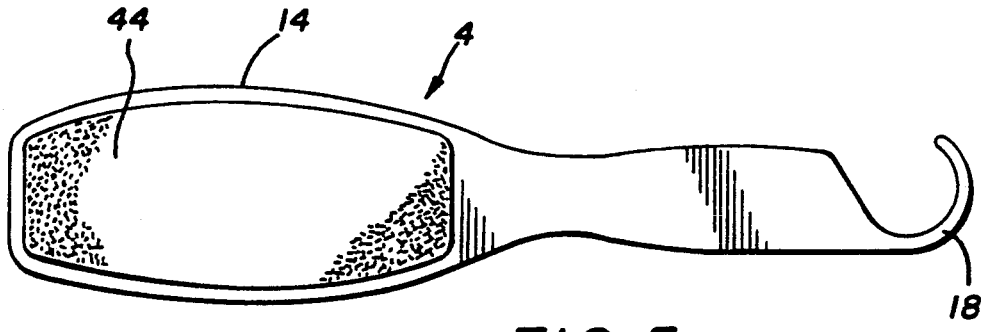
FIG. 5 is a top plan view of the completely assembled brush.

FIG. 1 illustrate the attachment of the insert plates to the block portion. FIG. 3 and 4 depict the manner in which the stakes 42 project through the block portion 14 and into apertures of the opposite insert plate, in press fit manner, to secure the assembly together. FIGS. 3 and 4 further demonstrate the function of reinforcement cylindrical bosses 40, 28, and how they support the stakes 42 along the length thereof, deterring breakage. Finally, FIGS. 3 and 4 illustrate the complementary arrangement of the stakes 42 of each plate and the corresponding apertures of the opposite plate.

From the above, it should be noted that a total of five components comprise the brush, with four of the components (the insert plates 6,8 and the pads 10,12) being duplicates. The assembly is therefore cost efficient. Also, since the body 4 is molded of one piece, the handle 16 can be solid, creating a much better "feel" to the user. In addition, by making the body 4 unitary in construction, the profiled height of the body 4 at the brush block portion 14 is relatively low. This is desirable since it minimizes the height of the brush for storage (as in a drawer), and makes the brush more comfortable to use.

Lastly, the reinforcement cylindrical bosses 28, and 40 create a reinforced pathway for each assembly stake 42, resisting breakage and adding strength to the overall block portion 14. The hollow, inward side of the insert plates 6,8, and the recesses in the brush block 14, remove material from the brush and thereby decrease its cost.

Figure 6:
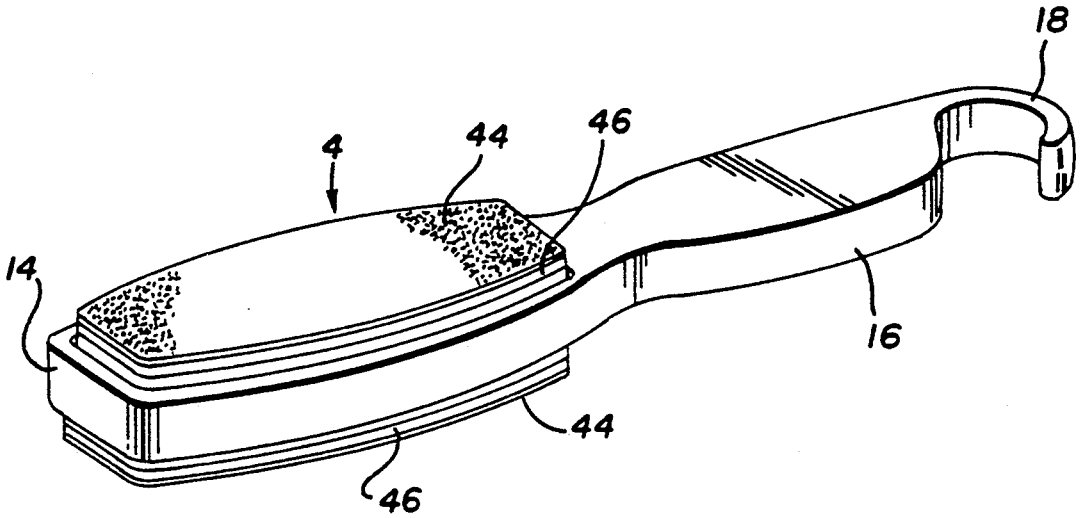
FIG. 6 is a left front perspective view of the assembled brush.

FIG. 6 illustrates that the overall profiled height of the assembled brush is small, making for easier storage, as in a drawer. Moreover, the pad portion of the brush, the block portion 14, in combination with the pad, is roughly the same in height as the handle portion. This relatively low, and uniform profile, across the length of the brush makes the brush easier to use, and to store.

Use of the subject brush is by conventional fashion, that is, by directionally running the lint attracting material 44 over a garment. The two sided feature of the brush makes it more convenient for left handed people, since, to operate effectively, the material 44 must contact the garment in a specified direction.

While the above constitutes the preferred embodiment, the invention should not be considered confined thereto. Other embodiments, which utilize the teachings herein set forth are intended to be within the scope and spirit of the invention.

We claim:

1. A brush for removal of lint, comprising: a unitarily formed, one-piece brush body having a handle portion at one end and a brush block portion at an opposite end, said brush block portion having oppositely directed top and bottom surfaces, each said surface having an outwardly open recess formed to extend therein, each recess defined by a bottom floor surface and sidewalls, and said brush block portion having at least two throughbores extending therethrough, substantially perpendicular to said top and bottom surfaces;

a pair of insert plate members dimensioned and shaped for close receipt within a respective one brush block recess, each said insert member having a top, a bottom, and side surfaces, a plurality of teeth spaced-apart and positioned to project outwardly from the side surfaces, at least one aperture extending into said bottom surface, and at least one stake projection directed outward from said bottom surface, and positioned to extend through one said brush body throughbore and into the aperture of the other insert plate member, in force fit fashion, to secure said insert plate members to said brush body and within said brush body recesses; and a pair of lint removing pad members dimensioned to overlap a respective one of said insert plate members top surface and having a lower edge portion positioned to overlap and engage said insert plate member teeth, whereby securing said pad member to said insert plate member.

2. A brush according to claim 1, wherein said brush insert plate members are identically formed and reversible, such that one said insert plate member may be inserted into either recess of said brush block.

3. A brush according to claim 2, wherein said teeth extend from a lower peripheral edge of said insert plate member side surfaces.

4. A brush according to claim 3, wherein said teeth extend substantially perpendicular to said insert plate member side surface.

5. A brush according to claim 2, wherein said stakes and said brush block through-bores, and said insert member apertures are positioned apart and spaced across said brush block portion.

6. A brush according to claim 5, wherein said brush body and insert members are formed of plastic material.

7. A brush according to claim 6, wherein the profiled height of said brush block portion, with said insert plate members and said pad members is substantially equivalent to the profiled height of the handle portion.

* * * * *